US007628274B2

(12) United States Patent
Matsuoka et al.

(10) Patent No.: US 7,628,274 B2
(45) Date of Patent: Dec. 8, 2009

(54) CAKE-SHAPED DECORATIVE ACCESSORY MADE OF A TOWEL IN A CUP

(75) Inventors: Yoshiyuki Matsuoka, Osaka (JP); Tadayoshi Iwaki, Osaka (JP)

(73) Assignee: Prairie Dog Co., Ltd., Osaka (JP)

( * ) Notice: Subject to any disclaimer, the term of this patent is extended or adjusted under 35 U.S.C. 154(b) by 476 days.

(21) Appl. No.: 11/318,963

(22) Filed: Dec. 27, 2005

(65) Prior Publication Data

US 2006/0138011 A1 Jun. 29, 2006

(30) Foreign Application Priority Data

Dec. 28, 2004 (JP) ..... 2004-007762 U

(51) Int. Cl.
*B65D 5/52* (2006.01)
*B65D 85/18* (2006.01)

(52) U.S. Cl. ..... 206/497; 428/7

(58) Field of Classification Search ..... 206/570, 206/457, 217, 494, 812; 428/7–28
See application file for complete search history.

(56) References Cited

U.S. PATENT DOCUMENTS 3,483,908 A * 12/1969 Donovan ..... 221/260
5,551,570 A * 9/1996 Shaffer et al. ..... 206/575

FOREIGN PATENT DOCUMENTS

| | | | |
|---|---|---|---|
| JP | 47-10320 | | 4/1972 |
| JP | 49-121768 | | 10/1974 |
| JP | 53-5162 | | 1/1978 |
| JP | 63-112715 | | 5/1988 |
| JP | 3-16496 | | 2/1991 |
| JP | 3-22795 | | 3/1991 |
| JP | 3-22796 | | 3/1991 |
| JP | 3-39488 | | 4/1991 |
| JP | 6-15557 | | 4/1994 |
| JP | 6-15558 | | 4/1994 |
| JP | 08151089 | A * | 6/1996 |
| JP | 3031668 | | 11/1996 |
| JP | 3047641 | | 4/1998 |
| JP | 11-140707 | | 5/1999 |

* cited by examiner

*Primary Examiner*—Ehud Gartenberg
*Assistant Examiner*—Ernesto A Grano
(74) *Attorney, Agent, or Firm*—William L. Androlia; H. Henry Koda

(57) ABSTRACT

A cake-shaped decorative accessory made of a towel in a cylindrically shaped cup. The towel is inserted in a cylindrical shaped cup with the top portion of the towel protruding from the opening of the cup. The opening of the cup has a larger diameter than the bottom, and the protruding portion of the towel is formed into a dome shape. The towel is of a square shape with the four corners folded back in the same direction so that the four corners are at the center of the towel to form a double layer, the double layered towel is further folded back so that the four corners are at the center of the towel to form four layers in a square shape, a center portion of the four layered towel is expanded into a dome shape which upwardly protrudes out of the opening of the cylindrically shaped cup.

3 Claims, 4 Drawing Sheets

CAKE-SHAPED DECORATIVE ACCESSORY MADE OF A TOWEL IN A CUP

BACKGROUND OF THE INVENTION

1. Field of the Invention

Present invention relates to a decorative accessory made of a towel, and more specifically relates to a decorative accessory made of a towel that makes the observer think of an actual cake using a cylindrical shaped cup.

2. Description of the Related Art

Currently, towels sold as, for instance, a gift are folded in various manner and arranged in a storage box, and the top side of the storage box is covered with a transparent film, so that the customers can see the arranged towel(s) inside the box through the film, thus drawing the attention of the customers and increase the customer's desire to purchase. Among these, with the focus on characteristics such as the towel's texture, thickness, and flexibility, some towels are formed into animals and dolls by way of attaching the towel cloth by sewing or fastening with a pin or the like, thus being offered exclusively as decorations.

Cake-shaped decorations using towels are known, and towels folded into a rolled cake shape and towels in a rolled cake shape and entirely packaged in decorative containers are also known well, as disclosed in, for example, Japanese Utility Model Application Laid-Open (Kokai) Nos. 3-39488, 3-22795 and 3-22796.

Meanwhile, in recent years, there has been an increasing demand for cake-shaped decorative accessories using a towel cloth as a gift or present, and there has been a demand for other types of decorative accessories that have a cake shape.

BRIEF SUMMARY OF THE INVENTION

In view of the problems above, it is an object of the present invention to provide a cake-shaped decorative accessory made of a towel that is not seen in the past, and it is another object of the present invention to provide a decorative accessory made of a towel in which the shape of the towel is cute and eye-catching and which is perfect for gifts, presents, or the like.

As a result of earnest research to achieve the objects noted above, the inventors found that a decorative accessory made of a towel that closely resembles an actual cake in a cup can be obtained by a towel that is put in a cylindrical shaped cup made of paper or the like used for muffin cakes, shortcake, or the like, and a protruding portion of the towel is formed in an actual cake shape, thus completing the present invention.

More specifically, the above object is accomplished by a unique structure of the present invention for a cake-shaped decorative accessory made of a towel in a cup in which a towel is inserted in a cylindrical shaped cup, and a part of the towel is formed so as to protrude out of the opening of the cup.

In the present invention, the cylindrical shaped cup means a cup that has a shape of cylinder in which the horizontal cross section has the same diameter from the top to the bottom; however, as long as the horizontal cross section is circular, cups in which the vertical cross section is trapezoidal with the diameter of the top portion being larger than the bottom portion and vice versa can be employed. Also, as long as the overall shape is in a cylinder, it is of course also possible to use a cup that has decorations of a pleat or the like on the cup wall. The material of the cup is not especially limited; but preferably, the cup is made of paper or plastic; and more preferably, a cap that is made of paper or plastic and commonly used for actual cakes is used. Furthermore, as long as the cup is has cylindrical shape, it is used in the present invention; however, as describe in detail below, it is preferable to use a cup in which the opening diameter is larger than the bottom diameter.

Though there are no particular limitations to the material for the towel cloth, it is preferable to use a cotton towel.

In the present invention, a cylindrical shaped cup that has the opening diameter larger than that the bottom diameter is used, and the outer layer (top portion) of the protruding portion of the towel is formed into a dome shape.

In this case, the dome shape of the outer layer of the outwardly protruding portion can be formed immediately from the upper edge or the opening of the cup, or it can be formed so as to start from the portion that is above the upper edge or the opening of the cup. In this case, the ratio of the height of the towel's protruding portion (the distance between the vertex of the dome shaped top portion of the towel and the upper edge of the cup wall) and the height of the cup wall is preferably between 5:50 and 50:50, and more preferably between 10:50 and 30:50.

Furthermore, in the present invention, the cylindrical shaped cup has its opening diameter larger than that of the bottom portion, and at least the outer layer of the towel protruding portion is formed into a spiral shape in the surface view or when viewed from above.

Here, the phrase "in the surface view" means "when viewing the surface of the main body of the cake made of a towel." In this case as well, the ratio of the height of the towel's protruding portion from the cup opening (the difference between the top part of the cylindrical shaped top of the towel and the upper edge of the cup wall) and the height of the cup wall is preferably between 5:50 and 50:50, and more preferably between 10:50 and 30:50.

In the present invention, decorations can be added to the outer layer of the spiral shaped towel.

The decorations include actual or imitation items of fruit such as strawberries and cherries or plants such as flowers or the like.

In the present invention, as described above, the ratio of the height of the protruding portion and the height of the cylindrical shaped cup is between 5:50 and 50:50, and preferably between 10:50 and 30:50; and further, the cylindrical shaped cup and towel can be entirely packaged in a transparent film or bag.

As seen from the above, according to the present invention, since the towel cloth texture, expansion, flexibility, and the like create the appearance of actual cake in a cup, people's eyes are drawn by the cute cake shape, and the towel cake can be used as a gift item perfect for presentation or as a decorative item for interior decorations. Also, when the towel in the cake shape is taken out of the cup and unfolded, it returns to its original shape, and it is used as a towel; and the decorations decorated the spiral-shaped towel can be used for other purposes.

DETAILED DESCRIPTION OF THE INVENTION

The aspects of implementing the present invention are as described below. However, the description is for nothing but the examples of implementing the present invention, and the present invention is not limited to the shown embodiments.

Figure 1A:
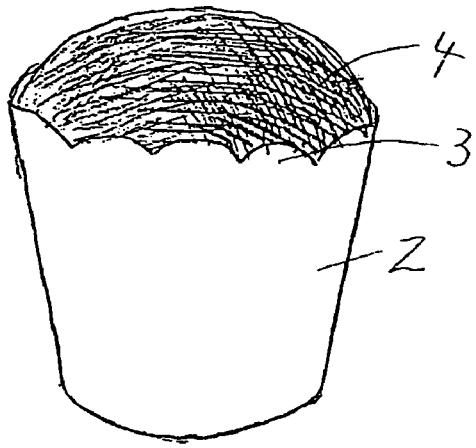
FIG. 1A is a perspective view of the muffin cake-shaped decorative accessory made of a towel according to the present invention.
Figure 1B:
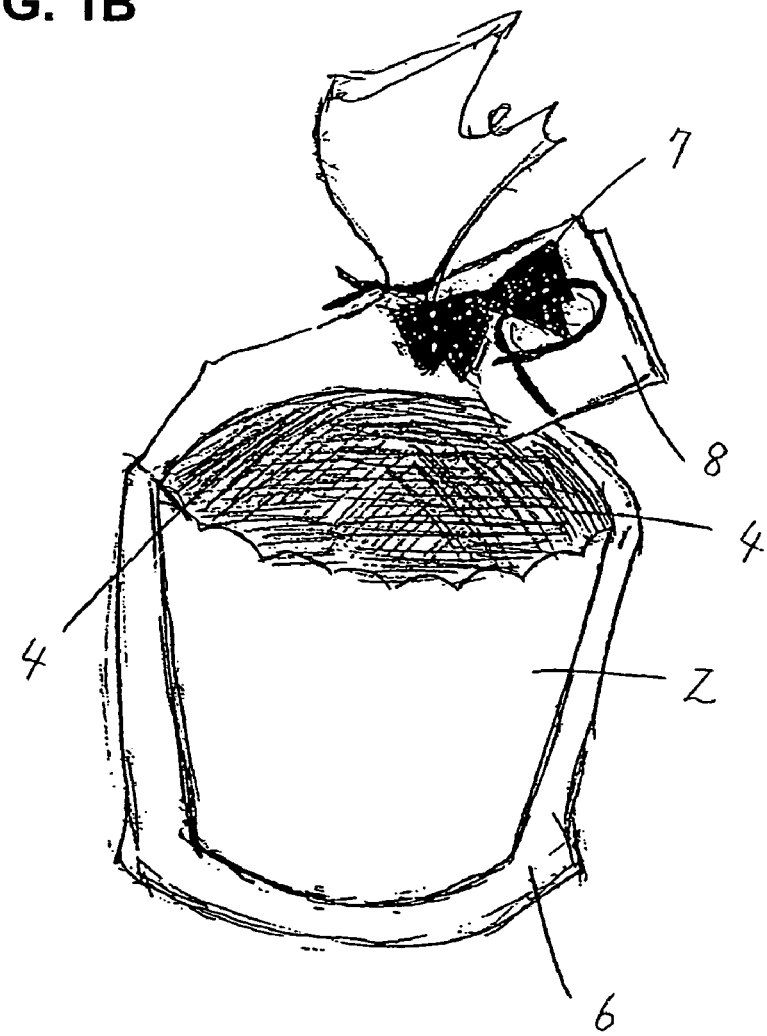
FIG. 1B is a perspective view of the decorative accessory of FIG. 1A packaged in a transparent film bag, thus being completed as a packaged product.

FIG. 1A shows an example of the cake-shaped decorative accessory made from a towel in a cylindrical shaped cup according to the present invention, for which a part of the towel protruding from the cup is dome-shaped. FIG. 1B shows the cake-shaped decorative accessory of FIG. 1A in a transparent film bag and packaged, with the area near the opening of the bag is closed and tied by a decorative string or the like and with a ribbon and label attached to the tied portion, thus being completed as a packaged product.

Figure 2:
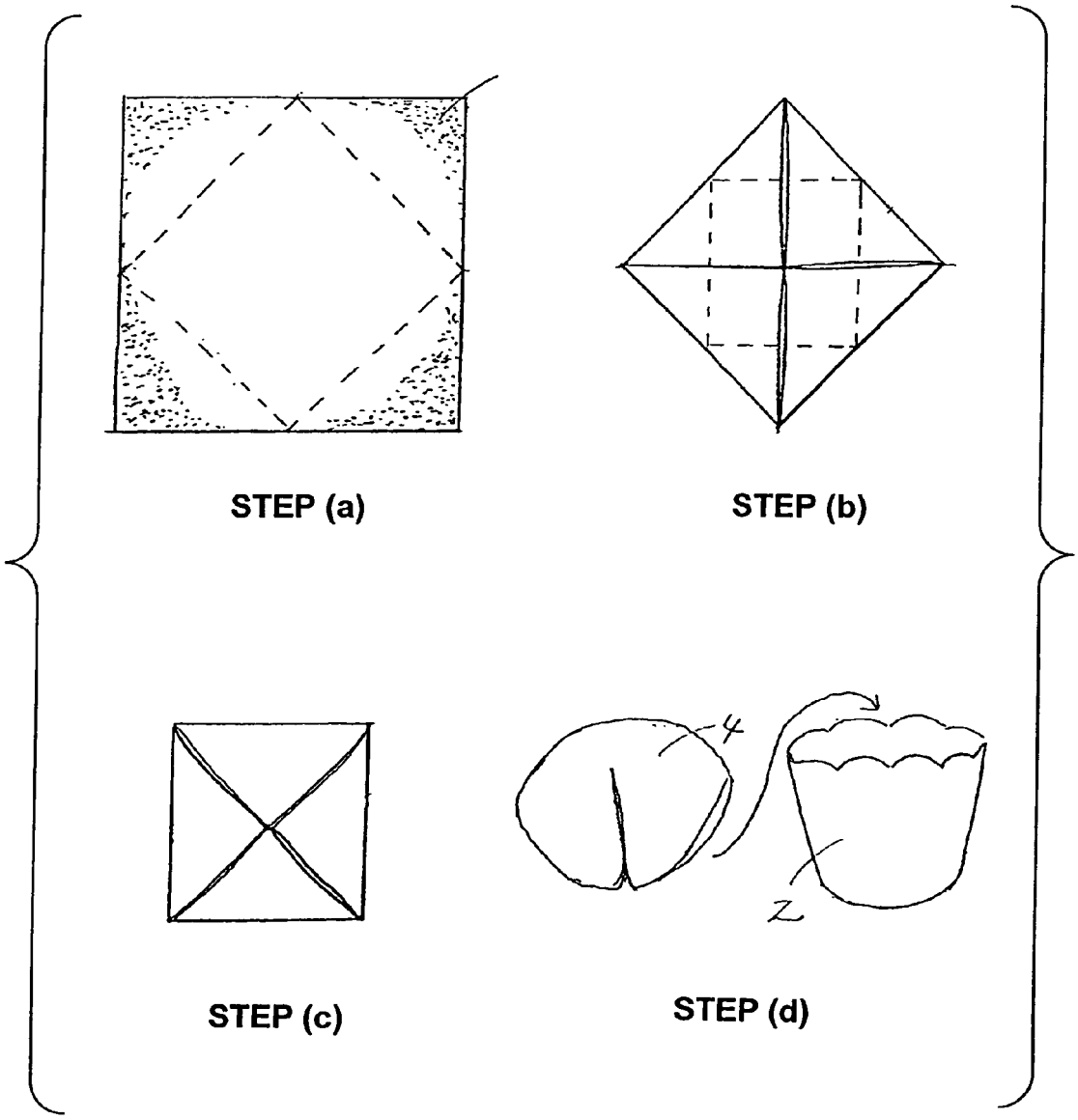
FIG. 2 shows the manufacturing steps (a) through (d) of the muffin cake-shaped decorative accessory made of a towel according to the present invention, wherein in step (a) the square shaped towel is spread, in step (b) the towel is folded, in step (c) the towel is further folded, and in step (d) the folded towel is formed into a dome shape and put in a cup.

The cake-shaped decorative accessory made from a towel as shown in FIG. 1A is obtained by the manufacturing steps of FIG. 2. More specifically, in step (a), a square towel cloth 1 is spread flat, and the towel is folded back along the dotted lines in the same decoration so that the four corners are placed at the center of the towel cloth 1 and the towel forms a double layer. Then in step (b), the thus obtained two layered folded towel is further folded along the dotted lines, so that the square towel have four overlapping layers in step (c). In step (d), the center portion of the four-layered square towel cloth 1 is expanded into a dome shape, and then the dome-shaped towel is put in a cup 2 in which the opening diameter is larger than the bottom diameter with the top portion of the towel protruding above the opening edge of the cup 2, thus being completed as a cake-shaped towel in a cup.

The reason for forming the outer layer of the protruding portion of the towel into a dome shape is to make the towel closely resemble or look alike an actual dome shaped cake. Therefore, in this case, it is preferable that the ratio of the height of the protruding portion of the towel (the difference between the vertex of the dome shape and the upper edge of the cup wall) and the height of the cup wall as well as the dome shape closely resemble an actual cake.

The color and size of the towel cloth 1 can be suitably selected to match the color and size of an actual cake. Also, as seen from FIG. 1B, the cake-shaped decorative accessory in a cup having a dome-shape at the top can be placed in a transparent film bag, so that the opening of the bag is closed and tied with a plastic material such as a decorative wire or the like. It is also possible to add a ribbon or the like. As a result, the towel becomes a decorative accessory that appears as attractive and delicious as a real cake is obtained.

Figure 3A:
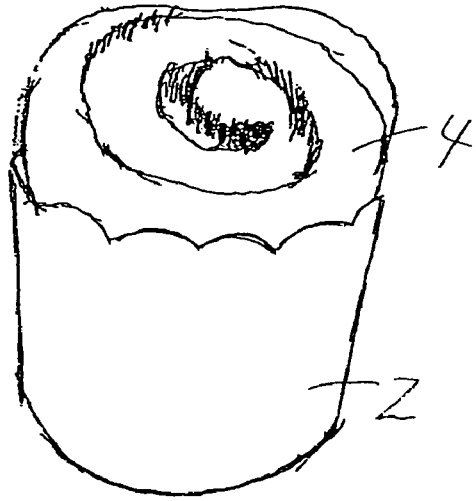
FIG. 3A is a perspective view of the decorative accessory made of a towel formed in a spiral cake shape according to the present invention.

FIG. 3A shows another example of a cake-shaped decorative accessory made of a towel in a cylindrical shaped cup according the present invention.

Figure 3B:
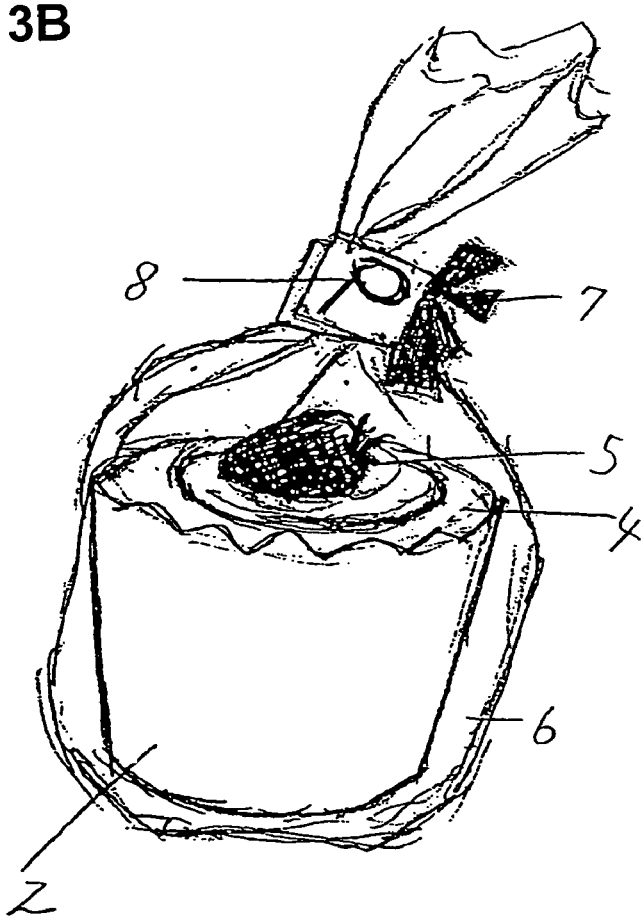
FIG. 3B is a perspective view of the decorative accessory of FIG. 3A having an imitation strawberry decoration and packaged in a transparent film bag.

The decorative accessory made of a towel for which a part of the towel that protrudes out from the cup has a cylindrical shape, and it is formed in a spiral cake shape in the surface view; and as shown in FIG. 3B, after putting a decoration such as a strawberry or cherry or the like on top of the protruding portion, the towel decorative accessory is put in a transparent film bag and packaged, and the open area of the bag is closed and tied with a decorative string or the like, thus being completing as a packaged product.

Figure 4:
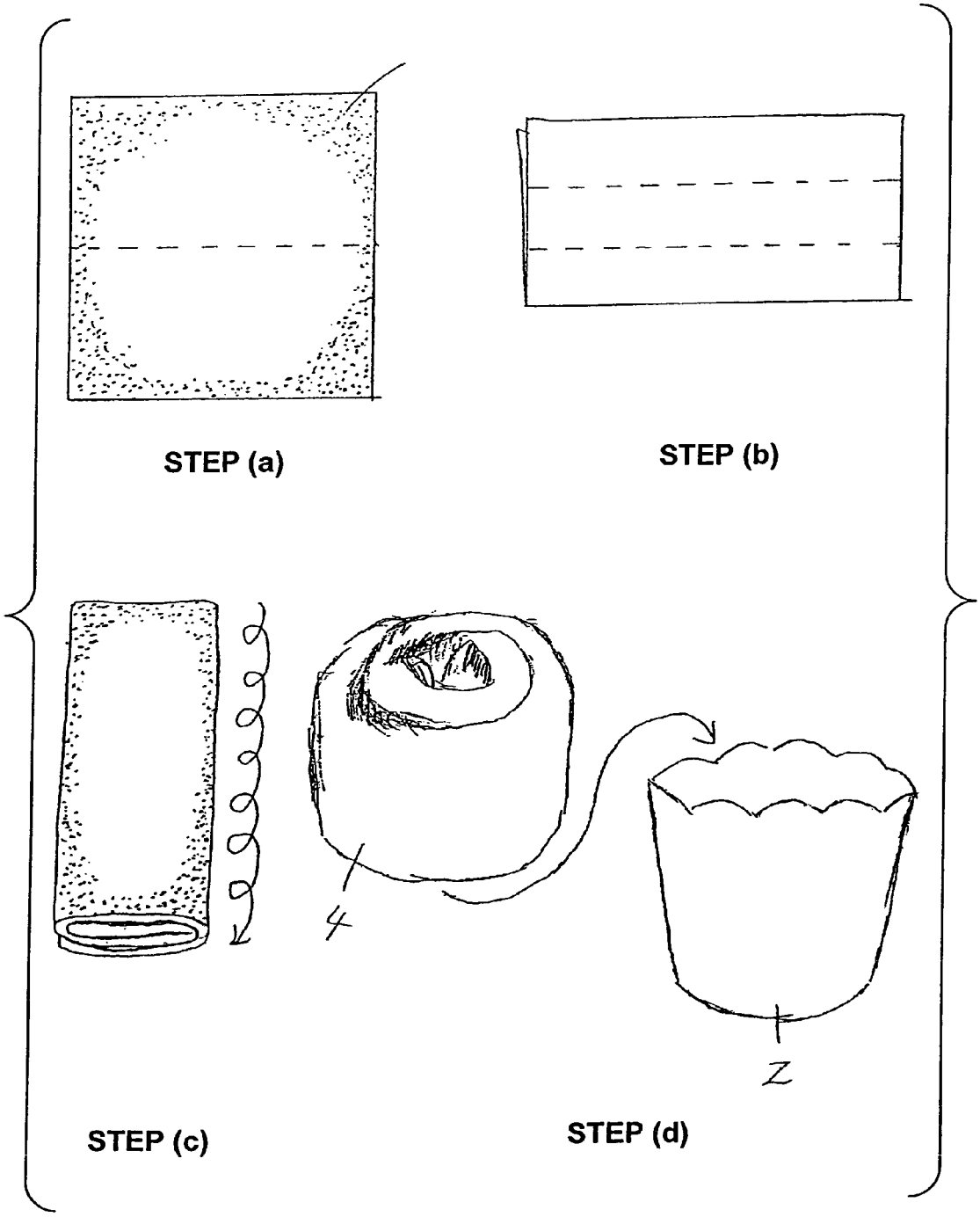
FIG. 4 shows the manufacturing steps (a) through (d) of the spiral cake-shaped decorative accessory made of a towel according to the present invention, wherein in step (a) the square shaped towel is spread, in step (b) the towel is folded, in step (c) the towel is further folded, and in step (d) the folded towel is rolled up and put in a cup.

The decorative accessory made of a towel of FIG. 3A is completed by the following steps shown in FIG. 4. In step (a), a square shaped towel cloth 1 is spread and folded back along the dotted lines passing through the center of the towel cloth 1 so that the towel cloth 1 takes a double layered rectangular shape. Then, this rectangular towel is further folded in step (b) so that the both top and bottom end portions are brought in the same direction along the two dotted lines (which divide the short sides equally into three parts), thus forming a rectangular shape with six overlapping layers, then in step (c) this six-layer rectangular towel cloth 1 is rolled up in the lengthwise direction as shown by the spiral arrows, and in step (d) the rolled towel (towel cake body) 4 formed so that the surface looks like to have a spiral shape and looks: overall like a cylindrical shape is put in a cup 2, in which the opening diameter is larger than the bottom diameter and the opening edge has a wave shape, so that the top portion (or the outer layer) of the cylinder-shaped towel protrudes out of the cup 2. In this case, it is preferable that the ratio of the height of the protruding portion of the towel (the difference between the top portion of the cylindrical shaped towel and the upper edge of the cup wall) and the height of the cup wall and the cake shape be closely resemble an actual spiral-shaped rolled cake in a cup.

In the above, the color and size of the towel cloth are selected so that the towel cake body suitably matches the color and shape of an actual cake, thus resulting in a decorative accessory that appears as attractive and delicious as a real cake. Furthermore, as seen from FIG. 3B, after adding a decoration such as a strawberry 5 or cherry or the like on top of the towel cake body, the towel cake body is packaged in a transparent film bag 6, and the opening of the bag 6 is closed and tied with a decorative string or the like, thus being completed as a packaged product that has an enhanced exterior appearance.

The present invention will be further described below with reference to its embodiments, but present invention is not limited to the shown embodiments.

As seen from FIG. 2, a towel handkerchief 1 of a square shape that is approximately 200 mm on each side is folded in sequence by the steps (a) to (c), thus obtaining a square-shaped item with four overlapping layers of the towel cloth, and this square handkerchief item is rounded to the inside with its center portion expanded to form a dome shape in step (d). This dome-shaped item is put in a paper cup 2 that has an opening diameter of 70 mm, a bottom diameter of 55 mm, and a height of 50 mm (the opening edge 3 is in a waved shape (see FIG. 1A)) so that the dome shaped portion of the folded towel handkerchief 1 protrudes from the opening of the cup 2, thus being completed as a dome-shaped cake-figure decorative accessory made from a towel in a cup shown in FIG. 1A.

In this case, the ratio of the height of the protruding portion of the towel (the difference between the dome shaped vertex and the upper edge of the cup wall (vertex of the wave of the opening)) and the height of the cup 2 (height from the bottom up to the vertex of the waved edge) is approximately 15:50. The color of the towel cloth 1 is yolk color or chocolate color, and the cup 2 is brown or pale brown in color.

Next, this cake-shaped towel product in the cup 2 is put in a transparent polypropylene film bag 6 of 130 mm in width and 223 mm in height as seen from FIG. 1B, and the opening of the bag 6 is closed and tied with a thin wire covered by gold-colored decorative tape, and a red ribbon 7 and a label (tag) 8 are attached. As a result, a decorative accessory that closely resembles a muffin-shaped cake that appears as attractive and delicious as a real muffin cake is obtained.

As seen from the steps shown in FIG. 4, for the cake shaped towel shown in FIG. 3A, a square-shaped towel handkerchief 1 of approximately 350 mm on each side is folded in sequence in steps (a) to (c), so that the square-shaped towel handkerchief 1 is formed into a rectangular item of six overlapping layers. This rectangular item is then rolled in the lengthwise direction so that it has a spiral form and it looks overall like a cylinder in step (d), and this cylindrical product (towel cake body) 4 is put in a paper cup 2 that has the opening diameter of 70 mm, the bottom diameter of 55 mm, and the height of 50 mm (the edge of the opening has a wave shape), so that an top portion of the cylindrical shaped product (towel cake body) 4 protrudes out of the opening of the cup 2. As a result, the cake-shaped decorative accessory towel of FIG. 3A is obtained.

In this case, the ratio of the height of the protruding portion of the towel (the difference between the dome shaped vertex and the upper edge of the cup wall (vertex of the wave of the opening)) and the height of the cup wall (height from the bottom up to the vertex of the wave) is approximately 15:50. The color of the towel cloth is yolk color or chocolate color, and the cup 2 is brown or pale brown in color.

Next, as seen from FIG. 3B, the towel cake body 4 in the cup 2 is put in a transparent polypropylene film bag 6 of 130 mm in width and 223 mm in height, and the opening of the bag 6 is closed and tied with a thin wire covered by gold-colored decorative tape. A strawberry decoration 5 is added to the top of the towel cake body 4. As a result, a decorative accessory that closely resembles a spiral shortcake in a cup that appears as attractive and delicious as a real shortcake is obtained. When the decorative item 5 like an imitation strawberry has a magnet attached to its back, even after the cake-shaped towel product is unfolded and the decorative item 5 is removed from the towel, the decorative item 5 has an advantage that it can be used as a memo clip or the like.

As seen from the above, the present invention provides a cake-shaped decorative accessory made of a towel specifically modeled after a cake in a cup, and the cake-shaped decorative accessory can be suitably used as a decorative item as for interior decor and as a decorative gift item.

The invention claimed is:

1. A cake-shaped decorative accessory made of a towel cloth and placed in a cylindrical shaped cup that has an opening larger in diameter than a diameter of a bottom of said cylindrical shaped cup, wherein said towel cloth is in a square shape;

four corners of said towel cloth are folded back in same direction so that the four corners are at a center of said towel cloth and thus said towel cloth forms a double layer;

said double-layered towel cloth is further folded back so that four corners thereof are at the center of said towel cloth and thus said towel cloth forms a four layers in a square shape;

a center-portion of said four-layered square towel cloth is expanded into a dome shape and placed in said cylindrical shaped cup; and a dome-shaped portion of said towel cloth upwardly protrudes out of the opening of said cylindrical shaped cup.

2. The cake-shaped decorative accessory made of a towel cloth in a cup according to claim 1, wherein said cylindrical shaped cup and towel cloth are wrapped together by a transparent film.

3. The cake-shaped decorative accessory made of a towel cloth in a cup according to claim 1, wherein a ratio of height of the protruding portion of said towel cloth to a height of said cylindrical shaped cup is between 5:50 and 50:50.

* * * * *